US008529732B2

(12) United States Patent
Esser et al.

(10) Patent No.: US 8,529,732 B2
(45) Date of Patent: Sep. 10, 2013

(54) METHOD FOR PRODUCING PAPER, CARD AND BOARD WITH HIGH DRY STRENGTH

(75) Inventors: Anton Esser, Limburgerhof (DE); Joerg Nieberle, Wachenheim (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/147,623

(22) PCT Filed: Feb. 4, 2010

(86) PCT No.: PCT/EP2010/051330

§ 371 (c)(1),
(2), (4) Date: Aug. 3, 2011

(87) PCT Pub. No.: WO2010/089334

PCT Pub. Date: Aug. 12, 2010

(65) Prior Publication Data

US 2011/0308752 A1 Dec. 22, 2011

(30) Foreign Application Priority Data

Feb. 5, 2009 (EP) ..... 09152163

(51) Int. Cl.

| | |
|---|---|
| ***D21H 17/42*** | (2006.01) |
| ***D21H 17/44*** | (2006.01) |
| ***D21H 17/28*** | (2006.01) |
| ***D21H 21/18*** | (2006.01) |

(52) U.S. Cl.
USPC ..... 162/158; 162/164.1; 162/168.1; 162/168.2; 162/169; 162/175

(58) Field of Classification Search
USPC ..... 162/158, 164.1, 164.6, 168.1–168.3, 162/169, 175, 179, 183
See application file for complete search history.

(56) References Cited

U.S. PATENT DOCUMENTS

| | | | | |
|---|---|---|---|---|
| 4,121,966 | A * | 10/1978 | Amano et al. | 162/164.1 |
| 4,263,094 | A * | 4/1981 | Login et al. | 162/164.7 |
| 4,445,970 | A | 5/1984 | Post et al. | |
| 4,925,530 | A * | 5/1990 | Sinclair et al. | 162/164.1 |
| 4,940,514 | A * | 7/1990 | Stange et al. | 162/168.2 |
| 5,851,300 | A * | 12/1998 | Linhart et al. | 127/32 |
| 6,521,088 | B1 * | 2/2003 | Richardson et al. | 162/175 |
| 6,576,086 | B1 * | 6/2003 | Ettl et al. | 162/164.3 |
| 6,710,175 | B2 * | 3/2004 | Anderson et al. | 536/45 |
| 6,746,542 | B1 * | 6/2004 | Lorencak et al. | 127/32 |
| 6,843,888 | B2 * | 1/2005 | Merrette et al. | 162/175 |
| 7,074,845 | B2 * | 7/2006 | Laleg | 524/47 |
| 2002/0170693 | A1 * | 11/2002 | Merrette et al. | 162/175 |
| 2005/0252629 | A1 * | 11/2005 | Laleg | 162/158 |
| 2007/0181274 | A1 * | 8/2007 | Esser et al. | 162/168.2 |
| 2008/0302496 | A1 * | 12/2008 | Laleg et al. | 162/164.1 |
| 2009/0145566 | A1 * | 6/2009 | Esser et al. | 162/164.6 |
| 2010/0078138 | A1 * | 4/2010 | Laleg | 162/175 |
| 2010/0179248 | A1 | 7/2010 | Esser et al. | |
| 2010/0181037 | A1 | 7/2010 | Esser et al. | |
| 2010/0181038 | A1 | 7/2010 | Esser et al. | |
| 2010/0186915 | A1 | 7/2010 | Esser et al. | |
| 2010/0280203 | A1 | 11/2010 | Feuerhake et al. | |
| 2010/0305362 | A1 | 12/2010 | Feuerhake et al. | |
| 2011/0048660 | A1 | 3/2011 | Esser et al. | |
| 2011/0079365 | A1 | 4/2011 | Haehnle et al. | |
| 2011/0100575 | A1 | 5/2011 | Schmidt-Thuemmes et al. | |
| 2011/0108226 | A1 | 5/2011 | Schmidt-Thuemmes et al. | |
| 2011/0230601 | A1 * | 9/2011 | Nieberle et al. | 524/48 |
| 2011/0247775 | A1 * | 10/2011 | Sutman et al. | 162/164.6 |
| 2011/0308752 | A1 * | 12/2011 | Esser et al. | 162/164.6 |
| 2011/0308753 | A1 * | 12/2011 | Laleg et al. | 162/164.7 |

FOREIGN PATENT DOCUMENTS

| | | | |
|---|---|---|---|
| DE | 35 06 832 | | 8/1986 |
| EP | 193111 | A2 * | 9/1986 |
| EP | 0 438 744 | | 7/1991 |
| GB | 2 085 492 | | 4/1982 |
| WO | WO 9850630 | A1 * | 11/1998 |
| WO | WO 0026468 | A1 * | 5/2000 |
| WO | 01 36500 | | 5/2001 |
| WO | 2004 061235 | | 7/2004 |
| WO | 2006 056381 | | 6/2006 |
| WO | 2009 004077 | | 1/2009 |
| WO | 2009 043860 | | 4/2009 |
| WO | 2009 080613 | | 7/2009 |
| WO | 2009 138457 | | 11/2009 |
| WO | WO 2009156274 | A1 * | 12/2009 |
| WO | WO 2010089334 | A1 * | 8/2010 |

OTHER PUBLICATIONS

U.S. Appl. No. 13/502,885, filed Apr. 19, 2012, Esser.
International Search Report Issued Apr. 22, 2010 in PCT/EP10/051330 filed Feb. 4, 2010.
U.S. Appl. No. 13/130,841, filed May 24, 2011, Nieberle, et al.

* cited by examiner

*Primary Examiner* — Jose A Fortuna
(74) *Attorney, Agent, or Firm* — Oblon, Spivak, McClelland, Maier & Neustadt, L.L.P.

(57) ABSTRACT

Process for the production of paper, board and cardboard having high dry strength by addition of a water-soluble cationic polymer and of an anionic polymer to a paper stock, draining of the paper stock and drying of the paper products, wherein an aqueous dispersion of at least one anionic latex and at least one degraded starch is used as the anionic polymer.

19 Claims, No Drawings

METHOD FOR PRODUCING PAPER, CARD AND BOARD WITH HIGH DRY STRENGTH

CROSS REFERENCE TO RELATED APPLICATION

This application is a 371 of PCT/EP10/051330, filed on Feb. 4, 2010, and claims priority to European Patent Application No. 09152163.3, filed on Feb. 5, 2009.

The invention relates to a process for the production of paper, board and cardboard having high dry strength by addition of water-soluble cationic polymers and anionic polymers to a paper stock, draining of the paper stock and drying of the paper products.

In order to increase the dry strength of paper, a dry strength agent can either be applied to the surface of already dried paper or added to a paper stock prior to sheet formation. The dry strength agents are usually used in the form of a 1 to 10% strength aqueous solution. If such a solution of a dry strength agent is applied to the surface of paper, considerable amounts of water must be evaporated in the subsequent drying process. Since the drying step is very energy-intensive and since the capacity of the customary drying apparatuses on paper machines is in general not so large that it is possible to operate at the maximum possible production speed of the paper machine, the production speed of the paper machine must be reduced in order for the paper treated with the dry strength agent to be dried to a sufficient extent.

If, on the other hand, the dry strength agent is added to a paper stock prior to the sheet formation, the treated paper may be dried only once. DE 35 06 832 A1 discloses a process for the production of paper having high dry strength, in which first a water-soluble cationic polymer and then water-soluble anionic polymer are added to the paper stock. In the examples, polyethyleneimine, polyvinylamine, polydiallyldimethylammonium chloride and epichlorohydrin crosslinked condensates of adipic acid and diethylenetriamine are described as water-soluble cationic polymers. For example homo- or copolymers of ethylenically unsaturated $C_3$- to $C_5$-carboxylic acids are suitable as water-soluble anionic polymers. The copolymers comprise, for example, from 35 to 99% by weight of an ethylenically unsaturated $C_3$- to $C_5$-carboxylic acid, such as, for example, acrylic acid.

WO 04/061235 A1 discloses a process for the production of paper, in particular tissue, having particularly high wet and/or dry strengths, in which first a water-soluble cationic polymer which comprises at least 1.5 meq of primary amino functionalities per g of polymer and has a molecular weight of least 10 000 dalton is added to the paper stock. Particularly singled out here are partly and completely hydrolyzed homopolymers of N-vinylformamide. Thereafter, a water-soluble anionic polymer which comprises anionic and/or aldehydic groups is added. Especially the variability of the two-component systems described, with regard to various paper properties, including wet and dry strength, is emphasized as an advantage of this process.

WO 06/056381 A1 discloses a process for the production of paper, board and cardboard having high dry strength a separate addition of a water-soluble polymer comprising vinylamine units and of a water-soluble polymeric anionic compound to a paper stock, draining of the paper stock and drying of the paper products, the polymeric anionic compound used being at least one water-soluble copolymer which is obtainable by copolymerization of at least one N-vinylcarboxamide of the formula

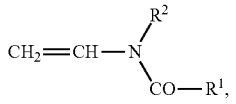

(I)

where $R^1$, $R^2$ are H or $C_1$- to $C_6$-alkyl, at least one monoethylenically unsaturated monomer comprising acid groups and/or the alkali metal, alkaline earth metal or ammonium salts thereof and optionally other monoethylenically unsaturated monomers and optionally compounds which have at least two ethylenically unsaturated double bonds in the molecule.

The prior European application with the application number EP 09 150 237.7 discloses a process for the production of paper having high dry strength by separate addition of a water-soluble cationic polymer and of an anionic polymer to a paper stock, the anionic polymer being an aqueous dispersion of a water-insoluble polymer having a content of not more than 10 mol % of acid groups or an anionic aqueous dispersion of a nonionic polymer. The draining of the paper stock and the drying of the paper products are then effected.

It is the object of the invention to provide a further process for the production of paper having high dry strength and wet strength which is as low as possible, the dry strength of the paper products being further improved as far as possible compared with the prior art.

The object is achieved, according to the invention, by a process for the production of paper, board and cardboard having high dry strength by addition of a water-soluble cationic polymer and of an anionic polymer to a paper stock, draining of the paper stock and drying of the paper products, wherein an aqueous dispersion of at least one anionic latex and at least one degraded starch is used as the anionic polymer.

While the cationic polymer is added to the paper stock in the form of diluted aqueous solutions having a polymer content of, for example, from 0.1 to 10% by weight, the addition of the anionic polymer is always effected as an aqueous dispersion. The polymer concentration of the aqueous dispersion can be varied within a wide range. Preferably, the aqueous dispersions of the anionic polymer are metered in dilute form; for example, the polymer concentration of the anionic dispersions is from 0.5 to 10% by weight.

Suitable cationic polymers are all water-soluble cationic polymers mentioned in the prior art cited at the outset. These are, for example, compounds carrying amino or ammonium groups. The amino groups may be primary, secondary, tertiary or quaternary groups. For the polymers, in essence addition polymers, polyaddition compounds or polycondensates are suitable, it being possible for the polymers to have a linear or branched structure, including hyperbranched or dendritic structures. Graft polymers may also be used. In the present context, the cationic polymers are referred to as being water-soluble if their solubility in water under standard conditions (20° C., 1013 mbar) and pH 7.0 is, for example, at least 10% by weight.

The molar masses of $M_w$ of the cationic polymers are, for example, at least 1000 g/mol. They are, for example, generally in the range from 5000 to 5 million g/mol. The charge densities of the cationic polymers are, for example, from 0.5 to 23 meq/g of polymer, preferably from 3 to 22 meq/g of polymer and in general from 6 to 20 meq/g of polymer.

Example of suitable monomers for the preparation of cationic polymers are:

Esters of α,β-ethylenically unsaturated mono- and dicarboxylic acids with amino alcohols, preferably $C_2$-$C_{12}$-amino alcohols. These will be $C_1$-$C_8$-monoalkylated or dialkylated at the amine nitrogen. Suitable acid components of these esters are, for example, acrylic acid, methacrylic acid, fumaric acid, maleic acid, itaconic acid, crotonic acid, maleic anhydride, monobutyl maleate and mixtures thereof. Acrylic acid, methacrylic acid and mixtures thereof are preferably used. These include, for example, N-methylaminomethyl (meth)acrylate, N-methylaminoethyl (meth)acrylate, N,N-dimethylaminomethyl (meth)acrylate, N,N-dimethylaminoethyl (meth)acrylate, N,N-diethylaminoethyl (meth)acrylate, N,N-dimethylaminopropyl (meth)acrylate, N,N-diethylaminopropyl (meth)acrylate and N,N-dimethylaminocyclohexyl (meth)acrylate.

Also suitable are the quaternization products of the above compounds with $C_1$-$C_8$-alkyl chlorides, $C_1$-$C_8$-dialkyl sulfates, $C_1$-$C_{16}$-epoxides or benzyl chloride.

In addition, N-[2-(dimethylamino)ethyl]acrylamide, N-[2-dimethylamino)ethyl]methacrylamide, N-[3-(dimethylamino)propyl]acrylamide, N-[3-(dimethylamino)propyl]methacrylamide, N[4-(dimethylamino)butyl]acrylamide, N-[4-(dimethylamino)butyl]methacrylamide, N-[2-(diethylamino)ethyl]acrylamide, N[2-(diethylamino)ethyl]methacrylamide and mixtures thereof are suitable as further monomers.

Also suitable are the quaternization products of the above compounds with $C_1$-$C_8$-alkyl chloride, $C_1$-$C_8$-dialkyl sulfate, $C_1$-$C_{16}$-epoxides or benzyl chloride.

Suitable monomers are furthermore N-vinylimidazoles, alkylvinylimidazoles, in particular methylvinylimidazoles, such as 1-vinyl-2-methylimidazole, 3-vinylimidazole N-oxide, 2- and 4-vinylpyridines, 2- and 4-vinylpyridine N-oxides and betaine derivatives and quaternization products of these monomers.

Further suitable monomers are allylamine, dialkyldiallylammonium chlorides, in particular dimethyldiallylammonium chloride and diethyldiallylammonium chloride, and the monomers disclosed in WO 01/36500 A1, comprising alkyleneimine units and of the formula (II)

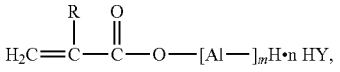

(II)

where

R is hydrogen or $C_1$- to $C_4$-alkyl,

—[Al—]$_m$ is a linear or branched oligoalkyleneimine chain having m alkyleneimine units, m is an integer in the range from 1 to 20, and the number average m in the oligoalkyleneimine chains is at least 1.5, Y is the anion equivalent of a mineral acid and n is a number such that $1 \leqq n \leqq m$.

Monomers or monomer mixtures in which the number average of m is at least 2.1, in general from 2.1 to 8, in the abovementioned formula (II) are preferred. They are obtainable by reacting an ethylenically unsaturated carboxylic acid with an oligoalkyleneimine, preferably in the form of an oligomer mixture. The resulting product can optionally be converted with a mineral acid HY into the acid addition salt. Such monomers can be polymerized to give cationic homo- and copolymers in an aqueous medium in the presence of an initiator which initiates a free radical polymerization.

Further suitable cationic monomers are disclosed in the prior European patent application 07 117 909.7. These are aminoalkyl vinyl ethers comprising alkyleneimine units and of the formula (III)

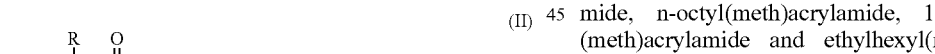

(III), where

[Al—]$_n$ is a linear or branched oligoalkyleneimine chain having n alkyleneimine units, n is a number of at least 1 and X is a straight-chain or branched $C_2$- to $C_6$-alkylene group, and salts of the monomers (III) with mineral acids or organic acids and quaternization products of the monomers (III) with alkyl halides or dialkyl sulfates. These compounds are obtainable by an addition reaction of alkyleneimines with amino-$C_2$- to $C_6$-alkyl vinyl ethers.

The abovementioned monomers can be polymerized alone to give water-soluble cationic homopolymers or together with at least one other neutral monomer to give water-soluble cationic copolymers or with at least one monomer having acid groups to give amphoteric copolymers which, in the case of a molar excess of cationic monomers incorporated in the form of polymerized units, carry an overall cationic charge.

Suitable neutral monomers which are copolymerized with the abovementioned cationic monomers for the preparation of cationic polymers are, for example, esters of α,β-ethylenically unsaturated mono- and dicarboxylic acids with $C_1$-$C_{30}$-alkanols, $C_2$-$C_{30}$-alkanediols, amides of α,β-ethylenically unsaturated monocarboxylic acids and the N-alkyl and N,N-dialkyl derivatives thereof, esters of vinyl alcohol and allyl alcohol with saturated $C_1$-$C_{30}$-monocarboxylic acids, vinylaromatics, vinyl halides, vinylidene halides, $C_2$-$C_8$-monoolefins and mixtures thereof.

Further suitable comonomers are, for example, methyl (meth)acrylate, methyl ethacrylate, ethyl (meth)acrylate, ethyl ethacrylate, n-butyl (meth)acrylate, isobutyl (meth) acrylate, tert-butyl (meth)acrylate, tert-butyl ethacrylate, n-octyl (meth)acrylate, 1,1,3,3-tetramethylbutyl (meth)acrylate, ethylhexyl (meth)acrylate and mixtures thereof.

Also suitable are acrylamide, substituted acrylamides, methacrylamide, substituted methacrylamides, such as, for example, acrylamide, methacrylamide, N-methyl(meth)acrylamide, N-ethyl(meth)acrylamide, N-propyl(meth)acrylamide, N-(n-butyl)(meth)acrylamide, tert-butyl(meth)acrylamide, n-octyl(meth)acrylamide, 1,1,3,3-tetramethylbutyl (meth)acrylamide and ethylhexyl(meth)acrylamide, and acrylonitrile and methacrylonitrile and mixtures of said monomers.

Further monomers for modifying the cationic polymers are 2-hydroxyethyl (meth)acrylate, 2-hydroxyethyl ethacrylate, 2-hydroxypropyl (meth)acrylate, 3-hydroxypropyl (meth) acrylate, 3-hydroxybutyl (meth)acrylate, 4-hydroxybutyl (meth)acrylate, 6-hydroxyhexyl (meth)acrylate, etc. and mixtures thereof.

Further suitable monomers for the copolymerization with the abovementioned cationic monomers are N-vinyllactams and derivatives thereof which may have, for example, one or more $C_1$-$C_6$-alkyl substituents, such as methyl, ethyl, n-propyl, isopropyl, n-butyl, sec-butyl, tert-butyl, etc. These include, for example, N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam, etc.

Suitable comonomers for the copolymerization with the abovementioned cationic monomers are furthermore ethylene, propylene, isobutylene, butadiene, styrene, α-methylstyrene, vinyl chloride, vinylidene chloride, vinyl fluoride, vinylidene fluoride and mixtures thereof.

A further group of comonomers comprises ethylenically unsaturated compounds which carry a group from which an amino group can be formed in a polymer-analogous reaction. These include, for example, N-vinylformamide, N-vinyl-N-methylformamide, N-vinylacetamide, N-vinyl-N-methylacetamide, N-vinyl-N-ethylacetamide, N-vinylpropionamide, N-vinyl-N-methylpropionamide and N-vinylbutyramide and mixtures thereof. The polymers formed therefrom can, as described in EP 0 438 744 A1, be converted by acidic or basic hydrolysis into polymers comprising vinylamine and amidine units (formulae IV-VII)

(IV)

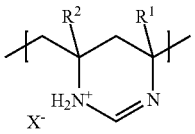

(V)

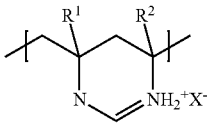

(VI)

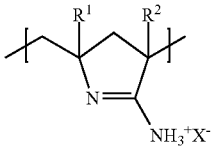

(VII)

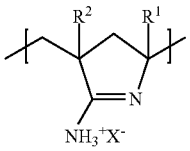

In the formulae IV-VII, the substituents $R^1$, $R^2$ are H, $C_1$- to $C_6$-alkyl and $X^-$ is an anion equivalent of an acid, preferably of a mineral acid.

For example, polyvinylamines, polyvinylmethylamines or polyvinylethylamines form in the hydrolysis. The monomers of this group can be polymerized in any desired manner with the cationic monomers and/or the abovementioned comonomers.

Cationic polymers are also to be understood for the purposes of the present invention as meaning amphoteric polymers which carry an overall cationic charge. In the amphoteric polymers, the content of cationic groups is, for example, at least 5 mol % above the content of anionic groups in the polymer. Such polymers are obtainable, for example, by copolymerizing a cationic monomer, such as N,N-dimethylaminoethyl-acrylamide, in the form of the free base, in the form partly neutralized with an acid or in quaternized form, with at least one monomer comprising acids groups, the cationic monomer being used in a molar excess so that the resulting polymers carry an overall cationic charge.

Amphoteric polymers are also obtainable by copolymerization of (a) at least one N-vinylcarboxamide of the formula (I)

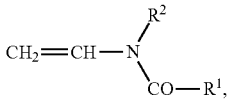

where $R^1$, $R^2$ are H or $C_1$- to $C_6$-alkyl, (b) at least one monoethylenically unsaturated carboxylic acid having 3 to 8 carbon atoms in the molecule and/or the alkali metal, alkaline earth metal or ammonium salts thereof and optionally (c) other monoethylenically unsaturated monomers and optionally (d) compounds which have at least two ethylenically unsaturated double bonds in the molecule, and subsequent partial or complete elimination of groups —CO—$R^1$ from the monomers of the formula (I) which are incorporated in the form of polymerized units in the copolymer, with formation of amino groups, the content of cationic groups, such as amino groups, in the copolymer being at least 5 mol % above the content of acid groups of the monomers (b) incorporated in the form of polymerized units. In the hydrolysis of N-vinylcarboxamide polymers, amidine units form in a secondary reaction by reaction of vinylamine units with a neighboring vinyl formamide unit. Below, the mention of vinylamine units in the amphoteric copolymers always means the sum of vinylamine and amidine units.

The amphoteric compounds thus obtainable comprise, for example, ($a_1$) optionally unhydrolyzed units of the formula (I), ($a_2$) vinylamine and amidine units, the content of amino plus amidine groups in the copolymer being at least 5 mol % above the content of monomers comprising acid groups and incorporated in the form of polymerized units, (b) units of a monoethylenically unsaturated monomer comprising acid groups and/or the alkali metal, alkaline earth metal or ammonium salts thereof, (c) from 0 to 30 mol % of units of at least one other monoethylenically unsaturated monomer and (d) from 0 to 2 mol % of at least one compound which has at least two ethylenically unsaturated double bonds in the molecule.

The hydrolysis of the copolymers can be carried out in the presence of acids or bases or enzymatically. In the hydrolysis with acids, the vinylamine groups forming from the vinylcarboxamide units are present in salt form. The hydrolysis of vinylcarboxamide copolymers is described in detail in EP 0 438 744 A1, page 8, line 20 to page 10, line 3. The statements made there apply accordingly for the preparation of the amphoteric polymers to be used according to the invention and having an overall cationic charge.

These polymers have, for example, K values (determined after H. Fikentscher in 5% strength aqueous sodium chloride solution at pH 7, a polymer concentration of 0.5% by weight and a temperature of 25° C.) in the range from 20 to 250, preferably from 50 to 150.

The preparation of the cationic homo- and copolymers can be effected by solution, precipitation, suspension or emulsion polymerization. Solution polymerization in the aqueous media is preferred. Suitable aqueous media are water and mixtures of water and at least one water-miscible solvent, for example an alcohol, such as methanol, ethanol, n-propanol, etc.

The polymerization temperatures are preferably in a range from about 30 to 200° C., particularly preferably from 40 to 110° C. The polymerization is usually effected under atmospheric pressure but can also take place under reduced or superatmospheric pressure. A suitable pressure range is from 0.1 to 5 bar.

For the preparation of the cationic polymers, the monomers can be polymerized with the aid of free radical initiators.

Free radical polymerization initiators which may be used are the peroxo and/or azo compounds customary for this purpose, for example alkali metal or ammonium peroxodisulfate, diacetyl peroxide, dibenzoyl peroxide, succinyl peroxide, di-tert-butyl peroxide, tert-butyl perbenzoate, tert-butyl perpivalate, tert-butyl peroxy-2-ethylhexanoate, tert-butyl permaleate, cumyl hydroperoxide, diisopropyl peroxydicarbamate, bis(o-toluoyl) peroxide, didecanoyl peroxide, dioctanoyl peroxide, dilauroyl peroxide, tert-butyl perisobutyrate, tert-butyl peracetate, di-tert-amyl peroxide, tert-butyl hydroperoxide, azobisisobutyronitrile, azobis(2-amidinopropane) dihydrochloride or 2-2'-azobis(2-methylbutyronitrile). Also suitable are initiator mixtures or redox initiator systems, such as, for example, ascorbic acid/iron(II) sulfate/sodium peroxodisulfate, tert-butyl hydroperoxide/sodium disulfite, tert-butyl hydroperoxide/sodium hydroxymethanesulfinate, $H_2O_2$/Cu(I) or iron(II) compounds.

For adjusting the molecular weight, the polymerization can be effected in the presence of at least one regulator. Regulators which may be used are the customary compounds known to the person skilled in the art, such as for example sulfur compounds, e.g. mercaptoethanol, 2-ethylhexyl thioglycolate, or thioglycolic acid, sodium hypophosphite, formic acid or dodecyl mercaptan and tribromochloromethane or other compounds which regulate the molecular weight of the polymers obtained.

Cationic polymers, such as polyvinylamines and copolymers thereof, can also be prepared by Hofmann degradation of polyacrylamide or polymethacrylamide and copolymers thereof, cf. H. Tanaka, Journal of Polymer Science: Polymer Chemistry edition 17, 1239-1245 (1979) and El Achari, X. Coqueret, A. Lablache-Combier, C. Loucheux, Makromol. Chem., Vol. 194, 1879-1891 (1993).

All the abovementioned cationic polymers can be modified by carrying out the polymerization of the cationic monomers and optionally of the mixtures of cationic monomers and the comonomers in the presence of at least one crosslinking agent. A crosslinking agent is understood as meaning those monomers which comprise at least two double bonds in the molecule, e.g. methylenebisacrylamide, glycol diacrylate, glycol dimethacrylate, glyceryl triacrylate, pentaerythritol triallyl ether, polyalkylene glycols which are at least diesterified with acrylic acid and/or methacrylic acid or polyols such as pentaerythritol, sorbitol or glucose. If at least one crosslinking agent is used in the copolymerization, the amounts used are, for example, up to 2 mol %, e.g. from 0.001 to 1 mol %.

Furthermore, the cationic polymer can be modified by the subsequent addition of crosslinking agents, i.e. by the addition of compounds which have at least two groups reactive to amino groups, such as, for example,

- di- and polyglycidyl compounds,
- di- and polyhalogen compounds,
- compounds having two or more isocyanate groups, possibly blocked carbonic acid derivatives,
- compounds which have two or more double bonds which are suitable for a Michael addition,
- di- and polyaldehydes,
- monoethylenically unsaturated carboxylic acids and the esters and anhydrides thereof.

Suitable cationic compounds are moreover polymers which can be produced by polyaddition reactions, such as, in particular, polymers based on aziridines. It is possible both for homopolymers to form but also graft polymers, which are produced by grafting of aziridines on other polymers. It may also be advantageous here to add, during or after the polyaddition, crosslinking agents which have at least two groups which can react with the aziridines or the amino groups formed, such as, for example, epichlorohydrin or dihaloalkanes (cf. Ullmann's Encyclopedia of Industrial Chemistry, VCH, Weinheim, 1992, chapter on aziridines).

Preferred polymers of this type are based on ethyleneimine, for example homopolymers of ethyleneimine which are prepared by polymerization of ethyleneimine or polymers grafted with ethyleneimine, such as polyamidoamines.

Further suitable cationic polymers are reaction products of dialkylamines with epichlorohydrin or with di- or polyfunctional epoxides, such as, for example, reaction products of dimethylamine with epichlorohydrin.

Other suitable cationic polymers are polycondensates, e.g. homo- or copolymers of lysine, arginine and histidine. They can be used as homopolymers or as copolymers with other natural or synthetic amino acids or lactams. For example, glycine, alanine, valine, leucine, phenylalanine, tryptophan, proline, asparagine, glutamine, serine, threonine or caprolactam are suitable for the copolymerization.

Furthermore, condensates of difunctional carboxylic acids with polyfunctional amines may be used as cationic polymers, the polyfunctional amines carrying at least two primary amino groups and at least one further less reactive, i.e. secondary, tertiary or quaternary, amino group. Examples are the polycondensation products of diethylenetriamine or triethylenetetramine with adipic, malonic, glutaric, oxalic or succinic acid.

Polysaccharides carrying amino groups, such as, for example, chitosan, are also suitable as cationic polymers.

Furthermore, all the polymers which are described above and carry primary or secondary amino groups can be modified by means of reactive oligoethyleneimines, as described in the prior European patent application 07 150 232.2. This application describes graft polymers whose grafting base is selected from the group consisting of polymers having vinylamine units, polyamines, polyamidoamines and polymers of ethylenically unsaturated acids and which comprise, as side chains, exclusively oligoalkyleneimine side chains. The preparation of graft polymers having oligoalkyleneimine side chains is effected by grafting at least one oligoalkyleneimine which comprises a terminal aziridine group onto one of said grafting bases.

In a preferred embodiment of the process according to the invention, a polymer having vinylamine units is used as the water-soluble cationic polymer.

In the process according to the invention, anionic polymers are also added to a paper stock, in addition to water-soluble cationic polymers described above.

According to the invention, the anionic polymer comprises at least one anionic latex and at least one degraded starch.

In the context of the present invention, the term latex is understood as meaning water-insoluble homo- and copolymers which are preferably used in the form of dispersions or emulsions.

In the context of the present invention, degraded starch is understood as meaning starches which have an average molecular weight Mw of from 1000 to 65 000.

The latex preferably comprises at least 40% by weight, preferably at least 60% by weight, particularly preferably at least 80% by weight, of so-called main monomers (a).

The main monomers (a) are selected from $C_1$-$C_{20}$-alkyl (meth)acrylates, vinyl esters of carboxylic acids comprising up to 20 carbon atoms, vinylaromatics having up to 20 carbon atoms, ethylenically unsaturated nitriles, vinyl halides, vinyl ethers of alcohols comprising 1 to 10 carbon atoms, aliphatic hydrocarbons having 2 to 8 carbon atoms and one or two double bonds or mixtures of these monomers.

For example, alkyl (meth)acrylates having a $C_1$-$C_{10}$-alkyl radical, such as methyl methacrylate, methyl acrylate, n-butyl acrylate, isobutylacrylate, ethyl acrylate and 2-ethylhexyl acrylate, may be mentioned.

In particular, mixtures of the alkyl (meth)acrylates are also suitable.

Vinyl esters of carboxylic acids having 1 to 20 carbon atoms are, for example, vinyl laurate, vinyl stearate, vinyl propionate, vinyl versatate and vinyl acetate.

Suitable vinylaromatic compounds having up to 20 carbon atoms are vinyltoluene, a- and p-methylstyrene, a-butylstyrene, 4-n-butylstyrene, 4-n-decylstyrene and preferably styrene. Examples of ethylenically unsaturated nitriles are acrylonitrile and methacrylonitrile.

The vinyl halides are ethylenically unsaturated compounds substituted by chlorine, fluorine or bromine, preferably vinyl chloride and vinylidene chloride.

For example, vinyl methyl ether or vinyl isobutyl ether may be mentioned as vinyl ethers of alcohols comprising 1 to 10 carbon atoms. Vinyl ethers of alcohols comprising 1 to 4 carbon atoms are preferred.

Ethylene, propylene, butadiene, isoprene and chloroprene may be mentioned as aliphatic hydrocarbons having 2 to 8 carbon atoms and one or two olefinic double bonds.

Preferred main monomers (a) are $C_1$-$C_{20}$-alkyl (meth) acrylates and mixtures of the alkyl (meth)acrylates with vinylaromatics, in particular styrene (also summarized as polyacrylate latex) or hydrocarbons having 2 double bonds, in particular butadiene, or mixtures of such hydrocarbons with vinylaromatics, in particular styrene (also summarized as polybutadiene latex).

In addition to the main monomers (a), the latex may comprise further monomers (b), e.g. monomers comprising hydroxyl groups, in particular $C_1$-$C_{10}$-hydroxyalkyl (meth) acrylates, and monomers having alkoxy groups, as are obtainable by alkoxylation of monomers comprising hydroxyl groups with alkoxides, in particular ethylene oxide or propylene oxide.

Further monomers (b) have compounds which have at least two double bonds capable of free radical polymerization, preferably 2 to 6, particularly preferably 2 to 4, very particularly preferably 2 or 3 and in particular 2. Such compounds are also referred to as crosslinking agents.

The at least two double bonds of the crosslinking agents (b), which double bonds are capable of free radical polymerization, can be selected from the group consisting of (meth) acrylate, vinyl ether, vinyl ester, allyl ether and allyl ester groups. Examples of crosslinking agents (b) are 1,2-ethanediol di(meth)acrylate, 1,3-propanediol di(meth)acrylate, 1,2-propanediol di(meth)acrylate, 1,4-butanediol di(meth)acrylate, 1,6-hexanediol di(meth)acrylate, neopentylglycol di(meth)acrylate, trimethylolpropanetriol di(meth) acrylate, pentaerythritol tetra(meth)acrylate, 1,4-butanediol divinyl ether, 1,6-hexanediol divinyl ether, 1,4-cyclohexanediol divinyl ether, divinylbenzene, allyl acrylate, allyl methacrylate, methallyl acrylate, methallyl methacrylate, but-3-en-2-yl (meth)acrylate, but-2-en-1-yl (meth)acrylate, 3-methylbut-2-en-1-yl (meth)acrylate, esters of (meth) acrylic acid with geraniol, citronellal, cinnamic alcohol, glyceryl mono- or diallyl ether, trimethylolpropane mono- or -diallyl ether, ethylene glycol monoallyl ether, diethylene glycol monoallyl ether, propylene glycol monoallyl ether, dipropylene glycol monoallyl ether, 1,3-propanediol monoallyl ether, 1,4-butanediol monoallyl ether and furthermore diallyl itaconate. Allyl acrylate, divinylbenzene, 1,4-butanediol diacrylate and 1,6-hexanediol diacrylate are preferred.

In addition, the anionic latex may comprise further monomers (c), e.g. monomers having carboxyl groups, salts or anhydrides thereof. For example, acrylic acid, methacrylic acid, itaconic acid, maleic acid or fumaric acid and aconitic acid may be mentioned. The content of ethylenically unsaturated acids in the latex is in general less than 10% by weight. The proportion of these monomers (c) is, for example, at least 1% by weight, preferably at least 2% by weight and particularly preferably at least 3% by weight. The acid groups of the latex can optionally be at least partly neutralized before subsequent use. Preferably, at least 30 mol %, particularly preferably 50-100 mol %, of the acid groups are neutralized. Volatile bases, such as ammonia, or nonvolatile bases, such as alkali metal hydroxides, in particular sodium hydroxide solution, are suitable as the base.

In a first embodiment of the present invention, the anionic latex consisting of the abovementioned monomers has a glass transition temperature (measured by means of DSC) of from −50 to +50° C., preferably from −50 to +10° C., particularly preferably from −40 to +5° C. and very particularly preferably from −30 to 0° C.

The glass transition temperature $T_g$ is generally known to the person skilled in the art. It means the limit of the glass transition temperature toward which the latter tends with increasing molecular weight, according to G. Kanig (Kolloid-Zeitschrift & Zeitschrift für Polymere, vol. 190, page 1, equation 1). The glass transition temperature is determined by the DSC method (Differential Scanning Calorimetry, 20 K/min, midpoint measurement, DIN 53765).

According to Fox (T. G. Fox, Bull. Am. Phys. Soc. 1956 [Ser. II] 1, page 123, and according to Ullmann's Encyclopädie der technischen Chemie, vol. 19, page 18, 4th edition, Verlag Chemie, Weinheim, 1980), the following is a good approximation for the glass transition temperature of at most weakly crosslinked copolymers:

$$1/T_g = x^1/T_g^1 + x^2/T_g^2 + \ldots x^n/T_g^n,$$

where $x^1, x^2, \ldots x^n$ are the mass fractions of the monomers 1, 2, . . . n and $T_g^1, T_g^2, \ldots T_g^n$ are the glass transition temperatures of the polymers composed in each case only of one of the monomers 1, 2, . . . n, in degrees Kelvin. The $T_g$ values for the homopolymers of most monomers are known and are listed, for example, in Ullmann's Encyclopedia of Industrial Chemistry, vol. part 5, vol. A21, page 169, VCH Weinheim, 1992. Further sources of glass transition temperatures of homopolymers are, for example, J. Brandrup, E. H. Immergut, Polymer Handbook, 1st Ed., J. Wiley, New York, 1966, 2nd Ed., J. Wiley, New York, 1975, and 3rd Ed., J. Wiley, New York, 1989.

With the aid of the abovementioned literature, the manner in which anionic latices having the corresponding glass transition temperature are obtained by the choice of the monomers is known to the person skilled in the art.

Preferably used anionic latices of this first embodiment are, for example, aqueous dispersions of (1) styrene and/or acrylonitrile or methacrylonitrile, (2) acrylates and/or methacrylates of $C_1$- to $C_{10}$-alcohols and optionally (3) acrylic acid, methacrylic acid, maleic acid and/or itaconic acid.

Aqueous dispersions of anionic latices of (1) styrene and/or acrylonitrile, (2) acrylates of $C_1$- to $C_4$-alcohols and optionally (3) acrylic acid are particularly preferred.

For example, such particularly preferred polyacrylate latices comprise 2-20% by weight of styrene, 2-20% by weight of acrylonitrile, 60-95% by weight of $C_1$-$C_4$-alkyl acrylates, preferably $C_4$-acrylates, such as n-butyl acrylate, isobutyl acrylate and/or tert-butyl acrylate, and 0-5% by weight of acrylic acid.

In a second embodiment of the present invention, the anionic latex comprises, in addition to the abovementioned monomers, at least one monomer comprising phosphonic and/or phosphoric acid groups, it being possible for the latter to be both monomers having a free acid group and salts, esters and/or anhydrides thereof.

Monomers which comprise phosphonic and/or phosphoric acid groups and are obtainable by esterification of monoethylenically unsaturated $C_3$-$C_8$-carboxylic acids with optionally monoalkoxylated phosphonic and/or phosphoric acids are preferred. Optionally monoalkoxylated monomers comprising phosphoric acid groups which are obtainable by esterification of monoethylenically unsaturated $C_3$-$C_8$-carboxylic acids with optionally monoalkoxylated phosphoric acids of the general formula (VIII)

$$H—[X]_n—P(O)(OH)_2 \quad (VIII)$$

where

X is a straight-chain or branched $C_2$-$C_6$-alkylene oxide unit and n is an integer from 0 to 20, are particularly preferred.

Preferably used monoalkoxylated phosphoric acids of the formula (VIII) are those in which X is a straight-chain or branched $C_2$-$C_3$-alkylene oxide unit and n is an integer from 5 to 15. X is particularly preferably an ethylene oxide or propylene oxide unit, particularly preferably a propylene oxide unit.

Of course, it is also possible to use any desired mixtures of different optionally monoalkoxylated phosphonic acids and optionally monoalkoxylated phosphoric acids of the formula (VIII) for esterification with a monoethylenically unsaturated $C_3$-$C_8$-carboxylic acid. Mixtures of monoalkoxylated phosphoric acids of the formula (VIII) which comprise the same alkylene oxide unit, preferably propylene oxide, but have a different degree of alkoxylation, preferably degree of propoxylation, are preferred. Particularly preferred mixtures of monoalkoxylated phosphoric acids comprise 5-15 units of propylene oxide, i.e. n is an integer from 5 to 15.

For the preparation of the monomers comprising phosphonic and/or phosphoric acid groups, monoethylenically unsaturated carboxylic acids having 3 to 8 carbon atoms are esterified with the abovementioned optionally monoalkoxylated phosphonic and/or phosphoric acids, preferably with the optionally monoalkoxylated phosphoric acids of the general formula (VIII). Such monoethylenically unsaturated $C_3$-$C_8$-carboxylic acids are, for example, acrylic acid, methacrylic acid, dimethacrylic acid, ethacrylic acid, maleic acid, citraconic acid, methylenemalonic acid, crotonic acid, fumaric acid, mesaconic acid and itaconic acid. Acrylic acid and methacrylic acid are preferably used.

Of course, it is also possible to use mixtures of monoethylenically unsaturated $C_3$-$C_8$-carboxylic acids for esterification with optionally monoalkoxylated phosphonic and/or phosphoric acids, preferably with optionally monoalkoxylated phosphoric acids of the formula (VIII). However, preferably only one monoethylenically unsaturated carboxylic acid, for example acrylic acid or methacrylic acid, is used.

Preferably used anionic latices of this second embodiment are, for example, aqueous dispersions of (1) styrene and/or acrylonitrile or methacrylonitrile, (2) acrylates and/or methacrylates of $C_1$- to $C_{10}$-alcohols and optionally (3) acrylic acid, methacrylic acid, maleic acid and/or itaconic acid and (4) (meth)acrylates of optionally monoalkoxylated phosphoric acids of the formula (VIII), where X and n have the abovementioned meaning.

Aqueous dispersions of anionic latices of (1) styrene and/or acrylonitrile, (2) acrylates of $C_1$ to $C_4$-alcohols and optionally (3) acrylic acid and (4) (meth)acrylates of monoalkoxylated phosphoric acids of the formula (VIII), where X is a propylene oxide unit and n is an integer from 5 to 15, are particularly preferred.

For example, such particularly preferred polyacrylate latices comprise 2-25% by weight of styrene, 2-25% by weight of acrylonitrile, 50-95% by weight of $C_1$-$C_4$-alkyl acrylates, preferably $C_4$-acrylates, such as n-butyl acrylate, isobutyl acrylate and/or tert-butyl acrylate, 0-5% by weight of acrylic acid and 0.1-5% by weight of (meth)acrylates of monoalkoxylated phosphoric acids of the formula (VIII), where X is a propylene oxide unit and n is an integer from 5 to 15.

Usually, the glass transition temperature (measured by means of DSC) of the anionic latices of the second embodiment are in the range from −40 to +50° C. Anionic latices having a glass transition temperature of from −20 to +20° C. and particularly preferably from −10 to +10° C. are preferably used in the aqueous slurries, according to the invention, of finely divided fillers.

The preparation of the anionic latices is effected independently of both aforementioned embodiments as a rule by emulsion polymerization; the polymer is therefore an emulsion polymer. The preparation of aqueous polymer dispersions by the free radical emulsion polymerization process is known per se (cf. Houben-Weyl, Methoden der organischen Chemie, volume XIV, Makromolekulare Stoffe, loc. cit., page 133 et seq.).

In the emulsion polymerization for the preparation of the latices, ionic and/or nonionic emulsifiers and/or protective colloids or stabilizers are used as surface-active compounds. The surface-active substance is usually used in amounts of from 0.1 to 10% by weight, in particular from 0.2 to 3% by weight, based on the monomers to be polymerized.

Customary emulsifiers are, for example, ammonium or alkali metal salts of higher fatty alcohol sulfates, such as sodium n-laurylsulfate, fatty alcohol phosphates, ethoxylated $C_8$- to $C_{10}$-alkylphenols having a degree of ethoxylation of from 3 to 30 and ethoxylated $C_8$- to $C_{25}$-fatty alcohols having a degree of ethoxylation of from 5 to 50. Mixtures of nonionic and ionic emulsifiers are also conceivable. Ethoxylated and/or propoxylated alkylphenols and/or fatty alcohols containing phosphate or sulfate groups are furthermore suitable. Further suitable emulsifiers are mentioned in Houben-Weyl, Methoden der organischen Chemie, volume XIV, Makromolekulare Stoffe, Georg Thieme Verlag, Stuttgart, 1961, pages 192 to 209.

Water-soluble initiators for the emulsion polymerization for the preparation of the latices are, for example, ammonium and alkali metal salts of peroxodisulfuric acid, e.g. sodium peroxodisulfate, hydrogen peroxide or organic peroxides, e.g. tert-butyl hydroperoxide. So-called reduction-oxidation (redox) initiator systems are also suitable.

The amount of initiators is in general from 0.1 to 10% by weight, preferably from 0.5 to 5% by weight, based on the monomers to be polymerized. It is also possible to use a plurality of different initiators in the emulsion polymerization.

In the emulsion polymerization, it is possible to use regulators, for example in amounts of from 0 to 3 parts by weight, based on 100 parts by weight of the monomers to be polymerized, by means of which, the molar mass is reduced. Suitable regulators are, for example, compounds having a thiol group, such as tert-butyl mercaptan, thioglycolic acid ethyl acrylate, mercaptoethynol, mercaptopropyltrimethoxysilane or tert-dodecyl mercaptan, or regulators without a thiol group, in particular, for example, terpinolene.

The emulsion polymerization for the preparation of the latices is effected as a rule at from 30 to 130° C., preferably of from 50 to 100° C. The polymerization medium may consist both only of water and of mixtures of water and liquids miscible therewith, such as methanol. Preferably, only water is used. The emulsion polymerization can be carried out both as a batch process and in the form of a feed process, including step or gradient procedure. Preferred is the feed process in which a part of the polymerization batch is initially taken, heated to the polymerization temperature and partly polymerized and then the remainder of the polymerization batch is fed to the polymerization zone continuously, stepwise or with superposition of a concentration gradient while maintaining the polymerization, usually via a plurality of spatially separate feeds, one or more of which comprise the monomers in pure or emulsified form. In the polymerization, a polymer seed may also be initially taken, for example for better adjustment of the particle size.

The manner in which the initiator is added to the polymerization vessel in the course of the free radical aqueous emulsion polymerization is known to the average person skilled in the art. It may be either completely initially taken in the polymerization vessel or used continuously or stepwise at the rate of its consumption in the course of a free radical emulsion polymerization. Specifically, this depends on the chemical nature of the initiator system as well as on the polymerization temperature. Preferably, a part is initially taken and the remainder is fed to the polymerization zone at the rate of consumption.

For removing the residual monomers, initiator is added, usually also after the end of the actual emulsion polymerization, i.e. after a conversion of the monomers of at least 95%.

The individual components can be added to the reactor in the feed process from above, at the side or from below through the reactor bottom.

After the copolymerization, the acid groups present in the latex may also be at least partly neutralized. This can be effected, for example, with oxides, hydroxides, carbonates or bicarbonates of alkali metals or alkaline earth metals, preferably with hydroxides, with which any desired counter-ion or a plurality thereof may be associated, e.g. $Li^+$, $Na^+$, $K^+$, $Cs^+$, $Mg^{2+}$, $Ca^{2+}$ or $Ba^{2+}$. Furthermore, ammonia or amines are suitable for the neutralization. Aqueous ammonium hydroxide, sodium hydroxide or potassium hydroxide solutions are preferred.

In the emulsion polymerization, aqueous dispersions of the latices as a rule with solids contents of from 15 to 75% by weight, preferably from 40 to 75% by weight, are obtained.

The particle size of the latices is preferably in the range from 10 to 1000 nm, particularly preferably in the range from 50 to 300 nm (measured using a Malvern® Autosizer 2 C).

The anionic polymers which can be used according to the invention comprise at least one anionic latex and at least one degraded starch. As described above, the degraded starches have an average molecular weight $M_w$ of from 1000 to 65 000 g/mol. The average molecular weights $M_w$ of the degraded starches can easily be determined by methods known to the person skilled in the art, for example by means of gel permeation chromatography with the use of a multiangle scattered-light detector.

In order to obtain such a starch, it is possible to start from all starch varieties, for example from native, anionic, cationic or amphoteric starch. The starch may originate, for example, from potatoes, corn, wheat, rice, tapioca or sorghum or may be waxy starches which have an amylopectin content of >80, preferably >95, % by weight, such as waxy cornstarch or waxy potato starch. The starches may be anionically and/or cationically modified, esterified, etherified and/or crosslinked. Cationized starches are preferred.

If the molecular weight $M_w$ of the starches is not already in the range from 1000 to 65 000 g/mol, their molecular weight is decreased. This decrease in molecular weight can be carried out oxidatively, thermally, acidolytically or enzymatically. A procedure in which a starch is enzymatically and/or oxidatively degraded is preferred. The molar mass $M_w$ of the degraded starch is preferably in the range from 2500 to 35 000 g/mol.

The use of anionic or of cationic starch is particularly preferred. Such starches are known. Anionic starches are prepared, for example, by reacting native starch with at least one quaternizing agent, such as 2,3-epoxypropyltrimethylammonium chloride. The cationized starches comprise quaternary ammonium groups.

The proportion of cationic or anionic groups in substituted starch is stated with the aid of the degree of substitution (DS). It is, for example, from 0.005 to 1.0, preferably from 0.01 to 0.4.

It is possible to use a single degraded starch or mixtures of two or more degraded starches.

In a particularly preferred form, maltodextrins are used as degraded starch. In the context of the present invention, maltodextrins are water-soluble carbohydrates which are obtained by enzymatic degradation of starch, consist of glucose units and have a dextrose equivalent.

The anionic polymers can be prepared in various ways from the at least one anionic latex and the at least one degraded starch. For example, the anionic latex is first prepared from the abovementioned monomers by emulsion polymerization. The degraded starch is then added and the components are mixed with one another. The addition of the degraded starch is usually effected at room temperature. It is also possible for the degraded starch to be added to the abovementioned monomers and for the emulsion polymerization thus to take place in the presence of the degraded starch.

Suitable fibers for the production of pulps are all qualities customary for this purpose, e.g. mechanical pulp, bleached and unbleached chemical pulp and paper stocks from all annual plants. Mechanical pulp includes, for example, groundwood, thermomechanical pulp (TMP), chemothermomechanical pulp (CTMP), pressure groundwood, semichemical pulp, high-yield chemical pulp and refiner mechanical pulp (RMP). For example, sulfate, sulfite and soda pulps are suitable as chemical pulp. Preferably unbleached chemical pulp, which is also referred to as unbleached kraft pulp, is used. Suitable annual plants for the production of paper stocks are, for example, rice, wheat, sugarcane, and kenaf. Pulps are generally produced using wastepaper, which is used either alone or as a mixture with other fibers, or fiber mixtures comprising a primary pulp and recycled coated waste, e.g. bleached pine sulfate mixed with recycled coated waste, are used as starting materials.

The process according to the invention is of industrial interest for the production of paper and board from waste paper because it substantially increases the strength properties of the recycled fibers and is particularly important for improving strength properties of graphic arts papers and of packaging papers. The papers obtainable by the process according to the invention surprisingly have a higher dry strength than the papers which can be produced by the process of the prior European application with the application number 09 150 237.7. At the same time, the retention of the fines and fillers from the stock used for the production is substantially increased by the process according to the invention, without the strength properties of the paper being adversely affected.

The pH of the stock suspension is, for example, in the range from 4.5 to 8, in general from 6 to 7.5. For example, an acid, such as sulfuric acid, or aluminum sulfate can be used for adjusting the pH.

In the process according to the invention, preferably the cationic polymer is first metered to the paper stock. The cationic polymer can be added to the high-density stock (fiber concentration >15 g/l, e.g. in the range from 25 to 40 g/l up to 60 g/l) or preferably to a low-density stock (fiber concentration <15 g/l, e.g. in the range from 5 to 12 g/l). The point of addition is preferably before the wires but may also be between a shearing stage and a screen or thereafter. The anionic polymer is preferably added to the paper stock only after the addition of the cationic polymer, but may also be metered to the paper stock simultaneously, but separately from the cationic polymer. Furthermore, it is also possible to add first the anionic and then the cationic polymer.

The cationic polymer is used, for example, in an amount of from 0.03 to 2.0% by weight, preferably from 0.1 to 0.5% by weight, based on dry paper stock. The water-insoluble anionic polymer is used, for example, in an amount of from 0.5 to 10% by weight, preferably from 1 to 6% by weight, in particular from 2.5 to 5.5% by weight, based on dry paper stock.

The weight ratio of water-soluble cationic polymer to water-insoluble anionic polymer is, based on the solids content, for example, from 1:5 to 1:20 and is preferably in the range from 1:10 to 1:15 and particularly preferably in the range from 1:10 to 1:12.

In the process according to the invention, the process chemicals usually used in papermaking can be used in the customary amounts, e.g. retention aid, draining agent, other dry strength agents, such as, for example, starch, pigments, fillers, optical brighteners, antifoams, biocides and paper dyes.

The invention is illustrated in more detail with reference to the following, nonlimiting examples.

EXAMPLES

The stated percentages in the examples are percent by weight, unless evident otherwise from the context.

The K value of the polymers was determined according to Fikentscher, Cellulose-Chemie, volume 13, 58-64 and 71-74 (1932) at a temperature of 20° C. in 5% strength by weight sodium chloride solutions at a pH of 7 and a polymer concentration of 0.5%. In this context, K=k 1000.

Cationic Polymer A

This polymer was prepared by hydrolysis of a poly-N-vinylformamide with hydrochloric acid. The degree of hydrolysis of the polymer was 50 mol %, i.e. the polymer comprised 50 mol % of N-vinylformamide units and 50 mol % of vinylamine units in salt form. The K value of the water-soluble cationic polymer was 90.

Cationic Polymer B

Preparation as described under cationic polymer A but with the exception that the degree of hydrolysis of the polymer was 30 mol %. The water-soluble cationic polymer comprised 70 mol % of N-vinylformamide units and 30 mol % of vinylamine units in salt form. The K value of the water-soluble cationic polymer was 90.

Anionic Polymer 1

411.6 g of demineralized water, 14.6 g of a polystyrene seed (solids content 33%, mean particle size 29 nm) and 1.4 g of a 45% strength by weight solution of dodecylphenoxybenzenedisulfonic acid sodium salt (Dowfax® 2A1, Dow Chemicals) and 15.4 g of a 7% strength by weight solution of sodium peroxodisulfate were initially taken in a 4 l vessel having a plane-ground joint and equipped with an anchor stirrer. The reaction vessel was heated to 93° C. via a regulated, external oil bath, with stirring. After the temperature had been reached, a previously prepared monomer emulsion consisting of 534.4 g of demineralized water, 22.4 g of a 15% by weight solution of sodium laurylsulfate (Disponil® SDS 15, Cognis), 8 g of a 45% strength by weight solution of dodecylphenoxybenzenedisulfonic acid sodium salt (Dowfax® 2A1, Dow Chemicals), 12 g of a 10% strength by weight solution of sodium hydroxide, 35 g of acrylic acid, 168 g of styrene, 829 g of n-butyl acrylate and 168 g of acrylonitrile was metered in uniformly in the course of 2 hours and 45 minutes. At the same time, 49.7 g of a 7% strength by weight solution of sodium peroxodisulfate were metered in. The batch was stirred for a further 45 minutes while keeping the temperature constant. Thereafter, 93.6 g of a 10% strength by weight solution of sodium hydroxide were added and the reactor content was cooled to 60° C. Thereafter, two feeds consisting of a) 24 g of a 10% strength by weight solution of tert-butyl hydroperoxide and b) 33 g of a 13% strength by weight solution comprising the adduct of 2.67 g of sodium disulfite and 1.62 g of acetone were metered in simultaneously in the course of 30 minutes. The reactor content was cooled to room temperature.

A virtually coagulum-free polymer dispersion having a solids content of 51% by weight was obtained. The polymer had a glass transition temperature, measured via DSC, of +5° C.

By adding 810 g of demineralized water, the solids content was reduced to 30% by weight. 404 g of a 30% by weight solution of a maltodextrin (from Cargill, MD® 09015) were then admixed.

The mixture obtained had a solids content of 30% by weight and a pH of 6.5.

Anionic Polymer 2

Polymer 2 was prepared analogously to polymer 1, but a solution of a maltodextrin diluted to 30% by weight (from Cerestar, starch 019 S1) was used during the mixing.

Anionic Polymer 3

411.6 g of demineralized water, 14.6 g of a polystyrene seed (solids content 33%, mean particle size 29 nm) and 1.4 g of a 45% strength by weight solution of dodecylphenoxybenzenedisulfonic acid sodium salt (Dowfax® 2A1, Dow Chemicals) and 15.4 g of a 7% strength by weight solution of sodium peroxodisulfate were initially taken in a 4 l vessel having a plane-ground joint and equipped with an anchor stirrer. The reaction vessel was heated to 93° C. via a regulated, external oil bath, with stirring. After the temperature had been reached, a previously prepared monomer emulsion consisting of 534.4 g of demineralized water, 22.4 g of a 15% by weight solution of sodium laurylsulfate (Disponil® SDS 15, Cognis), 8 g of a 45% strength by weight solution of dodecylphenoxybenzenedisulfonic acid sodium salt (Dowfax® 2A1, Dow Chemicals), 12 g of a 10% strength by weight solution of sodium hydroxide, 36 g of acrylic acid, 60 g of styrene, 1044 g of n-butyl acrylate and 60 g of acrylonitrile was metered in uniformly in the course of 2 hours. 49.8 g of a 7% strength by weight solution of sodium peroxodisulfate were metered in simultaneously in 2.5 hours. The batch was stirred for a further 45 minutes while keeping the temperature constant. Thereafter, 93.6 g of a 10% strength by weight solution of sodium hydroxide were added and the reactor content was cooled to 60° C. Thereafter, two feeds consisting of a) 24 g of a 10% strength by weight solution of tert-butyl hydroperoxide and b) 33 g of a 13% strength by weight solution comprising the adduct of 2.67 g of sodium disulfite and 1.62 g of acetone were metered in simultaneously in the course of 30 minutes. The reactor content was cooled to room temperature.

A virtually coagulum-free polymer dispersion having a solids content of 50% by weight was obtained. The polymer had a glass transition temperature, measured via DSC, of −25° C.

By adding 810 g of demineralized water, the solids content was reduced to 30% by weight. 404 g of a 30% by weight solution of a maltodextrin (from Cargill, MD® 09015) were then admixed.

The mixture obtained had a solids content of 30% by weight and a pH of 6.4.

Anionic Polymer 4

340.8 g of demineralized water, 14.6 g of a polystyrene seed (solids content 33%, mean particle size 29 nm) and 1.4 g of a 45% strength by weight solution of dodecylphenoxybenzenedisulfonic acid sodium salt (Dowfax® 2A1, Dow Chemicals) and 15.4 g of a 7% strength by weight solution of sodium peroxodisulfate were initially taken in a 4 l vessel having a plane-ground joint and equipped with an anchor stirrer. The reaction vessel was heated to 93° C. via a regulated, external oil bath, with stirring. After the temperature had been reached, a previously prepared monomer emulsion consisting of 483.6 g of demineralized water, 22.4 g of a 15% by weight solution of sodium laurylsulfate (Disponil® SDS 15, Cognis), 8 g of a 45% strength by weight solution of dodecylphenoxybenzenedisulfonic acid sodium salt (Dowfax® 2A1, Dow Chemicals), 12 g of a 10% strength by weight solution of sodium hydroxide, 12 g of a methacrylate with an oligopropylene oxide esterified terminally with phosphoric acid (Sipomer® PAM 200: $CH_2{=}C(CH_3){-}COO{-}(CH_2CH(CH_3)O)_{8\text{-}10}{-}P(O)(OH)_2$, Rhodia), 24 g of acrylic acid, 168 g of styrene, 828 g of n-butyl acrylate and 168 g of acrylonitrile was metered in uniformly in the course of 2 hours and 45 minutes. At the same time, 87 g of a 4% strength by weight solution of sodium peroxodisulfate were metered in. The batch was stirred for a further 45 minutes while keeping the temperature constant. Thereafter, 62.4 g of a 10% strength by weight solution of sodium hydroxide were added and the reactor content was cooled to 60° C. Thereafter, two feeds consisting of a) 80 g of a 3% strength by weight solution of tert-butyl hydroperoxide and b) 53.4 g of demineralized water with 33 g of a 13% strength by weight solution comprising the adduct of 2.67 g of sodium disulfite and 1.62 g of acetone were metered in simultaneously in the course of 30 minutes. The reactor content was cooled to room temperature.

A virtually coagulum-free polymer dispersion having a solids content of 50% by weight was obtained. The polymer had a glass transition temperature, measured via DSC, of +4° C.

By adding 810 g of demineralized water, the solids content was reduced to 30% by weight. 404 g of a 30% by weight solution of a maltodextrin (from Cargill, MD® 09015) were then admixed.

The mixture obtained had a solids content of 30% by weight, a pH of 6.5 and a particle size, measured by dynamic light scattering (Malvern HPPS), of 137 nm.

Anionic Polymer 5

1064.6 g of demineralized water, 7.2 g of a polystyrene seed (solids content 33%, mean particle size 29 nm), 0.6 g of a 45% strength by weight solution of dodecylphenoxybenzenedisulfonic acid sodium salt (Dowfax° 2A1, Dow Chemicals) and 240.0 g of maltodextrin (from Cargill, MD® 09015) and 7.8 g of a 7% strength by weight solution of sodium peroxodisulfate were initially taken in a 4 l vessel having a plane-ground joint and equipped with an anchor stirrer. The reaction vessel was heated to 93° C. via a regulated, external oil bath, with stirring. After the temperature had been reached, a previously prepared monomer emulsion consisting of 267.2 g of demineralized water, 11.2 g of a 15% strength by weight solution of sodium laurylsulfate (Disponil® SDS 15, Cognis), 4 g of a 45% strength by weight solution of dodecylphenoxybenzenedisulfonic acid sodium salt (Dowfax® 2A1, Dow Chemicals), 6 g of a 10% strength by weight solution of sodium hydroxide, 18 g of acrylic acid, 84 g of styrene, 414 g of n-butyl acrylate and 84 g of acrylonitrile was metered in uniformly in the course of 2 hours. 34.8 g of a 2.5% strength by weight solution of sodium peroxodisulfate were metered in simultaneously in the course of 2.5 hours. The batch was stirred for a further 45 minutes while keeping the temperature constant. Thereafter, 46.8 g of a 10% strength by weight solution of sodium hydroxide were added and the reactor content was cooled to 60° C. Thereafter, two feeds consisting of a) 30 g of a 2% strength by weight solution of tert-butyl hydroperoxide and b) 55.6 g of demineralized water with 16.4 g of a 13% strength by weight solution comprising the adduct of 2.67 g of sodium disulfite and 1.62 g of acetone were metered in simultaneously in the course of 30 minutes. The reactor content was cooled to room temperature.

A virtually coagulum-free polymer dispersion having a solids content of 29.3% by weight, and a pH of 6.1 was obtained. The polymer had a glass transition temperature, measured via DSC, of +5° C. The particle size, measured by dynamic light scattering (Malvern HPPS), was 149 nm.

Preparation of a Paper Stock Suspension

A 0.5% strength aqueous stock suspension was prepared from 100% mixed wastepaper. The pH of the suspension was 7.1 and the freeness of the stock was 50° Schopper-Riegler (° SR). The stock suspension was then divided into eight equal parts and processed in examples 1 to 6 and in comparative examples 1 and 2, under the conditions stated in each case in the examples and comparative examples, on a Rapid Köthen sheet former according to ISO 5269/2 to give sheets having a basis weight of 120 g/m$^2$.

Example 1

The temperature of the paper stock suspension was about 20° C. 0.25% of polymer A (solid polymer, based on dry fiber) was added to the stock suspension. After a contact time of 5 minutes, the dispersion of the anionic polymer 1 was diluted by a factor of 10. The dilute dispersion was then metered into the fiber suspension with gentle stirring. The amount of anionic polymer 1 used was 5% (solid polymer, based on dry fiber). After a contact time of 1 minute, sheets were formed, which were then dried for 7 minutes at 90° C.

Example 2

The temperature of the paper stock suspension was about 20° C. 0.25% of polymer B (solid polymer, based on dry fiber) was added to the stock suspension. After a contact time of 5 minutes, the dispersion of the anionic polymer 1 was diluted by a factor of 10. The dilute dispersion was then metered into the fiber suspension with gentle stirring. The amount of anionic polymer 1 used was 5% (solid polymer, based on dry fiber). After a contact time of 1 minute, sheets were formed, which were then dried for 7 minutes at 90° C.

Example 3

Example 3 was carried out analogously to example 2 but the anionic polymer 2 was used.

Example 4

Example 4 was carried out analogously to example 2 but the anionic polymer 3 was used.

Example 5

Example 5 was carried out analogously to example 2 but the anionic polymer 4 was used.

Example 6

Example 6 was carried out analogously to example 2 but the anionic polymer 5 was used.

Comparative Example 1

Comparison with the Prior European Application Having the Application Number 09 150 237.7

The paper stock was heated to a temperature of 50° C. 0.25% of polymer B (solid polymer, based on dry fiber) was added to the stock suspension thus heated. After a contact time of 5 minutes, the dispersion of an anionic acrylate resin (solids content 50%), obtainable by suspension polymerization of 68 mol % of n-butyl acrylate, 14 mol % of styrene, 14 mol % of acrylonitrile and 4 mol % of acrylic acid, was diluted by a factor of 10. The mean particle size of the dispersed polymer particles was 192 nm. The dilute dispersion was then metered into the fiber suspension heated to 50° C., with gentle stirring. The amount of acrylate resin used was 5% (solid polymer, based on dry fiber). After a contact time of 1 minute, sheets were formed, which were then dried for 7 minutes at 90° C.

Comparative Example 2

A sheet was formed from the above-described stock suspension which had a temperature of 20° C., without further additives.

Testing of the Paper Sheets

After the sheets produced according to examples 1 to 6 and comparative examples 1 and 2 had been stored for 12 hours in a conditioned chamber at a constant temperature of 23° C. and 50% atmospheric humidity, in each case the dry breaking length of the sheets was determined according to DIN 54540. The determination of the CMT value of the conditioned sheets was effected according to DIN 53143 and that of the dry bursting pressure of the sheets was determined according to DIN 53141. The results are stated in Table 1.

TABLE 1

| Example | Dry breaking length (m) | Bursting pressure [kPa] | CMT30 [N] | Filler content [%] |
|---|---|---|---|---|
| 1 | 5632 | 586 | 291 | 11.7 |
| 2 | 5455 | 558 | 276 | 11.3 |
| 3 | 5491 | 545 | 269 | 10.7 |
| 4 | 5521 | 534 | 265 | 10.1 |
| 5 | 5412 | 565 | 271 | 11.1 |
| 6 | 5491 | 542 | 266 | 10.4 |
| Comparative example 1 | 4987 | 506 | 244 | 7.8 |
| Comparative example 2 | 3376 | 288 | 146 | 6.1 |

The examples and comparative examples show that the sheets according to the comparative examples have poorer strength properties in spite of the lower filler content.

We claim:

1. A process for the production of paper, board and cardboard comprising adding a water-soluble cationic polymer and an anionic polymer to a paper stock, draining of the paper stock and drying of the paper products, wherein the anionic polymer comprises an aqueous dispersion of at least one anionic latex and at least one degraded starch, and the degraded starch has an average molecular weight $M_w$, of from 2,500 to 35,000 g/mol.

2. The process according to claim 1, wherein the molar mass $M_w$ of the cationic polymer is in the range from 5000 to 5 million g/mol.

3. The process according to claim 2, wherein the anionic latex consists of (1) styrene and/or acrylonitrile or methacrylonitrile, (2) acrylates and/or methacrylates of $C_1$- to $C_{10}$-alcohols and optionally (3) acrylic acid, methacrylic acid, maleic acid and/or itaconic acid and (4) (meth)acrylates of optionally monoalkoxylated phosphoric acids of formula (VIII), $$H—[X]_n—P(O)(OH)_2 \quad \text{(VIII)}$$

where X is a straight-chain or branched $C_2$-$C_6$-alkylene oxide unit and n is an integer from 0 to 20.

4. The process according to claim 3, wherein the anionic latex consists of 2-25% by weight of styrene, 2-25% by weight of acrylonitrile, 50 -95% by weight of $C_1$-$C_4$-alkyl acrylates, 0-5% by weight of acrylic acid and 0.1- 5% by weight of (meth)acrylates of monoalkoxylated phosphoric acids of the formula (VIII), where X is a propylene oxide unit and n is an integer from 5 to 15.

5. The process according to claim 1, wherein the charge densities of the cationic polymer are in the range from 0.5 to 23 meq/g of polymer, and wherein the pH of the stock solution having at least the water-soluble cationic polymer is from 4.5 to 8.

6. The process according to claim 5, wherein the pH of the stock solution having at least the water-soluble cationic polymer is from 6 to 7.5.

7. The process according to claim 1, wherein the water-soluble cationic polymer is a polymer having vinylamine units.

8. The process according to claim 1, wherein the anionic latex consists of a) styrene and/or acrylonitrile or methacrylonitrile, b) acrylates and/or methacrylates of $C_1$-to $C_{10}$-alcohols and optionally c) acrylic acid, methacrylic acid, maleic acid and/or itaconic acid.

9. The process according to claim 8, wherein the anionic latex consists of 2-20% by weight of styrene, 2-20% by weight of acrylonitrile, 60-95% by weight of $C_1$-$C_4$-alkyl acrylates and 0-5% by weight of acrylic acid.

10. The process according to claim 1, wherein the anionic latex comprises at least one monomer comprising phosphonic groups, phosphoric acid groups, or both incorporated in the form of polymerized units.

11. The process according to claim 10, wherein the monomer comprises a phosphoric acid group and is obtained by a process comprising esterifying a monoethylenically unsaturated $C_3$-$C_8$-carboxylic acid with optionally a monoalkoxylated phosphoric acid of the general formula (VIII)

$$H—[X]_n—P(O)(OH)_2 \quad \text{(VIII)}$$

where

X is a straight-chain or branched $C_2$-$C_6$-alkylene oxide unit and n is an integer from 0 to 20.

12. The process according to claim 11, wherein in monoalkoxylated phosphoric acid of the formula (VIII), X is a straight-chain or branched $C_2$-$C_3$-alkylene oxide unit and n is an integer from 5 to 15 are used.

13. The process according to claim 11, wherein the monoethylenically unsaturated $C_3$-$C_8$-carboxylic acid is at least selected from the group consisting of acrylic acid, methacrylic acid, dimethylacrylic acid, ethacrylic acid, maleic acid, citraconic acid, methylenemalonic acid, crotonic acid, fumaric acid, mesaconic acid and itaconic acid.

14. The process according to claim 1, wherein the degraded starch is a maltodextrin.

15. The process according to claim 1, wherein the anionic latex comprises at least one monomer comprising phosphonic groups, phosphoric acid groups, or both incorporated in the form of polymerized units, and the monomer comprises a phosphoric acid group and is obtained by a process comprising esterifying a monoethylenically unsaturated $C_3$-$C_8$-carboxylic acid with optionally a monoalkoxylated phosphoric acid of the general formula (VIII)

$$H—[X]_n—P(O)(OH)_2 \quad \text{(VIII)}$$

where

X is a straight-chain or branched $C_2$-$C_3$-alkylene oxide unit and n is an integer from 5 to 15.

16. The process according to claim 15, wherein X represents an ethylene oxide unit.

17. The process according to claim 15, wherein X represents a propylene oxide unit.

18. The process according to claim 1, wherein said at least one anionic latex is in the form of particles in the aqueous dispersion, said particles having particle sizes of from 50 to 300 nm, measured with a Malvern Autosizer 2 C.

19. The process according to claim 1, wherein the degraded starch comprises starch having an amylopectin content of at least 80% by weight.

* * * * *